US011193663B2

(12) United States Patent
Wu

(10) Patent No.: US 11,193,663 B2
(45) Date of Patent: Dec. 7, 2021

(54) QUICK-CONNECT MODULAR LED LAMP STRIP

(71) Applicant: SHENZHEN SHINESKY OPTOELECTRONICS CO., LTD, Shenzhen (CN)

(72) Inventor: Bin Wu, Shenzhen (CN)

(73) Assignee: SHENZHEN SHINESKY OPTOELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/044,316

(22) PCT Filed: Sep. 2, 2019

(86) PCT No.: PCT/CN2019/103953
§ 371 (c)(1),
(2) Date: Sep. 30, 2020

(87) PCT Pub. No.: WO2020/199493
PCT Pub. Date: Oct. 8, 2020

(65) Prior Publication Data

US 2021/0270452 A1 Sep. 2, 2021

(30) Foreign Application Priority Data

Mar. 29, 2019 (CN) ..... 201910251108.0

(51) Int. Cl.
*F21V 23/06* (2006.01)
*F21S 4/24* (2016.01)
(Continued)

(52) U.S. Cl.
CPC ..... *F21V 23/06* (2013.01); *F21S 4/24* (2016.01); *F21V 19/0025* (2013.01); *F21V 23/005* (2013.01); *F21Y 2115/10* (2016.08)

(58) Field of Classification Search
None
See application file for complete search history.

(56) References Cited

U.S. PATENT DOCUMENTS 9,976,730 B1 * 5/2018 Deng ..... F21V 17/16

FOREIGN PATENT DOCUMENTS

CN 204554503 U 8/2015
CN 204962467 U 1/2016
(Continued)

OTHER PUBLICATIONS

International Search Report issued in corresponding international application No. PCT/CN2019/103953, dated Dec. 31, 2019.
(Continued)

*Primary Examiner* — Britt D Hanley

(57) ABSTRACT

A quick-connect modular LED lamp strip includes an H-shaped lamp body, a PC lampshade in a movably snap-fit connection with an upper portion of the lamp body, a plug wiring assembly connected with the lamp body, a printed circuit board (PCB) circuit board disposed inside the lamp body, and end caps disposed on each of head position of two ends of the lamp body and configured to block the two ends of the lamp body. The end caps are in an L-shaped structure, and each of the end caps includes an end cap insert configured to insert into the lamp body and at least one fixing column integrally formed with the end cap insert and configured to connect with the plug wiring assembly.

9 Claims, 5 Drawing Sheets

(51) Int. Cl.

| | |
|---|---|
| ***F21V 19/00*** | (2006.01) |
| ***F21V 23/00*** | (2015.01) |
| ***F21Y 115/10*** | (2016.01) |

(56) References Cited

FOREIGN PATENT DOCUMENTS

| | | | | |
|---|---|---|---|---|
| CN | 208124208 | U | * | 11/2018 |
| CN | 208124208 | U | | 11/2018 |
| CN | 109899717 | A | | 6/2019 |
| CN | 209399232 | U | | 9/2019 |
| JP | 2010198927 | A | | 9/2010 |

OTHER PUBLICATIONS

Written Opinion of the international Searching Authority for No. PCT/CN2019/103953, dated Dec. 31, 2019.

* cited by examiner

QUICK-CONNECT MODULAR LED LAMP STRIP

CROSS-REFERENCE TO RELATED APPLICATIONS

This disclosure is a National Stage Entry of PCT application No. PCT/CN2019/103953 filed on Sep. 2, 2019, which claims the priority to Chinese application No. CN201910251108.0, filed on Mar. 29, 2019 by SHENZHEN SHINESKY OPTOELECTRONICS CO., LTD, which is titled "Quick-Connect Modular LED Lamp Strip".

TECHNICAL FIELD

The present disclosure relates to a technical field of LED lamp strips, and in particular to a quick-connect modular LEI) lamp strip with reasonable structural design and high reliability.

BACKGROUND

For LED lamp strips in current market, end caps of both ends are mostly fixed with glue or screws, an LED light source plate is powered by a welding wire out method, and connection between the lamp strips is mostly in a form of a male plug wire connecting with a female plug wire. The scheme above is tedious and complicated in production, and has defects that has exposed wire harness, inconvenient installation, unattractive appearance, and discontinuous light after connecting.

How the appearance of the LED lamp strips can be effectively improved, the installation can be more convenient, and user experience can be enhanced are often considered by those skilled in the art. A large amount of relevant research and development and experiments are also performed, and better performance is achieved.

SUMMARY

The present disclosure provides a quick-connect modular LED lamp strip with reasonable structural design and high reliability to overcome above technical problems.

The present disclosure provides a quick-connect modular LED lamp strip, including an H-shaped lamp body, a PC lampshade in a movably snap-fit connection with an upper portion of the lamp body, a plug wiring assembly connected with the lamp body, a printed circuit board (PCB) circuit board disposed inside the lamp body, and end caps disposed on each of head position of two ends of the lamp body and configured to block the two ends of the lamp body. The end caps are in an L-shaped structure, and each of the end caps includes an end cap insert configured to insert into the lamp body and at least one fixing column integrally formed with the end cap insert and configured to connect with the plug wiring assembly. A lampshade clamping groove is disposed on an upper portion of one side of each of the end caps, a shape of the lampshade clamping groove matches with a shape of the PC lampshade, and the lampshade clamping groove is configured to clamp and fix the PC lampshade. A lamp panel groove is disposed on an upper portion of one side of the lamp body and is configured to clamp the PCB circuit board, and an insert groove is disposed on a lower portion of an inner side of the lamp body and is configured to insert the cap end inserts. Each of the end caps further includes an end cap power outlet formed on the end cap insert and a lamp body power outlet formed on each end of the lamp body and matched with a position where the end cap power outlet is located.

Furthermore, the fixing column is in an anti-buckling structure. A groove body is disposed on a middle portion of the fixing column and is configured to enable the fixing column to have internal shrinkage performance.

Furthermore, a tail end cap body is disposed on one side of the lamp body, Tail end cap fixing holes are formed on the tail end cap body, and the tail end cap fixing holes are matched with a position where the fixing column on each of the end cap inserts is located and are configured to block the lamp body power outlet on an end tail of the lamp body. Protrusions are disposed on both sides of the tail end cap body, the protrusions are matched with the end caps and are configured to quickly, position and connect the fixing column of one of the end caps with the tail end cap body.

Furthermore, guidance columns are integrally disposed on one side of the lampshade clamping groove on each of the end caps, the guidance columns are configured to limit and guide a process of inserting the end caps into the lamp body. Guidance grooves are disposed on the lamp body, and a shape of the guidance grooves is matched with a shape of the guidance columns.

Furthermore, an oblique latch is integrally disposed close to the end cap power outlet on each of the end caps, a latch hole matched with the oblique latch is disposed on the lamp body.

Furthermore, an electrical connector configured to connect other lamp strips is connected with one end of the lamp body. Connecting holes connected with the fixing column of each of the end caps are formed on the electrical connector. The electrical connector is a "-" shape, "T" shape, or "+" shape.

Furthermore, a fixing buckle is sleeved on an outer side of the lamp body.

Furthermore, electric welding disc contacts are disposed on a left end and a right end of a bottom of the PCB circuit board, and the electric welding disc contacts are located on a center of the lamp body and the end cap power outlet of each of the end cap inserts.

Furthermore, the plug wiring assembly includes a power wire, an FR-4 PCB plate, and a spring copper needle. The spring copper needle is welded and connected to the FR-4 PCB plate. Fixing holes, matched with the fixing columns of the end cap inserts and configured to fix the plug wiring assembly and the lamp body, are disposed on both sides of the spring copper needle.

Furthermore, plug wiring protrusions, configured to quickly position and connect the fixing column of each of the end caps and the plug wiring assembly, are disposed on both sides of the plug wiring assembly.

Compared with the prior art, the quick-connect modular LED lamp strip is simultaneously disposed with the H-shaped lamp body, the PC lampshade in the movably snap-fit connection with the upper portion of the lamp body, the plug wiring assembly connected with the lamp body, and combined with the Printed Circuit Board (PCB) circuit board disposed inside the lamp body and the end caps disposed on each of the head position of two ends of the lamp body and configured to block the two ends of the lamp body. Moreover, the end caps are in the L-shaped structure, and each of the end caps includes the end cap insert configured to insert into the lamp body and at least one fixing column integrally formed with the end cap insert and configured to connect with the plug wiring assembly. The lampshade clamping groove is disposed on the upper portion of one side of each of the end caps, the shape of the lampshade clamping groove matches with the shape of the PC lampshade, and the lampshade clamping groove is configured to clamp and fix the PC lampshade. The lamp panel groove is disposed on the upper portion of one side of the lamp body and is configured to clamp the PCB circuit board, and the insert groove is disposed on the lower portion of the inner side of the lamp body and is configured to insert the cap end inserts. Each of the end caps further includes an end cap power outlet formed on the end cap insert and a lamp body power outlet formed on each end of the lamp body and matched with a position where the end cap power outlet is located. A structure of the quick-connect LED lamp strip adopts a modular design concept, abandoning a backward wiring method, the lamp strip does no need to be welded, is free of glue, and has no need of fixing screws, which simplifies a production process. Through a simple structural design, one lamp is quickly connected with another lamp, and a connection between the two lamps achieves an effect that there is no shadow, which is with an excellent appearance and high cost performance, and further enhances product texture and user experience.

DETAILED DESCRIPTION

In order to make objects, technical solutions and advantages of the present disclosure more clearly understood, the present disclosure is further described in details below in connection with the accompanying drawings and embodiments. It should be understood that the specific embodiments described herein are for illustrative purposes only and are not intended to limit the present disclosure.

Figure 1:
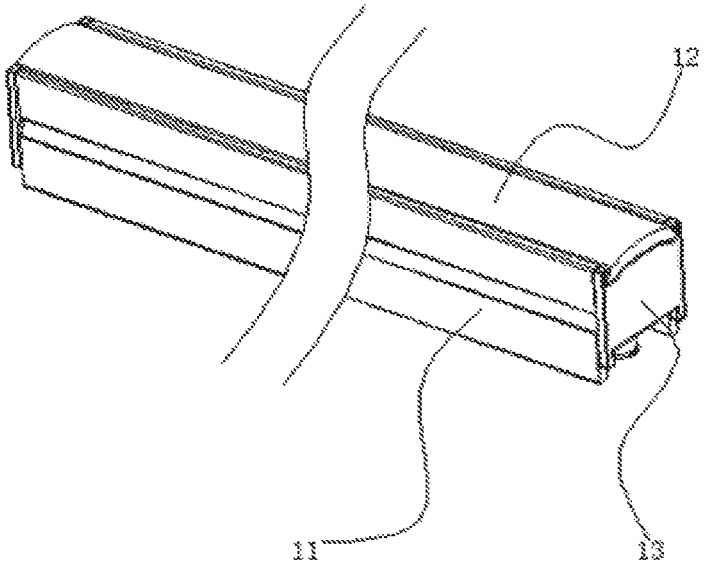
FIG. 1 and FIG. 2 are structural schematic diagrams of a three-dimensional state of a quick-connect modular LED lamp strip according to the present disclosure.
Figure 2:
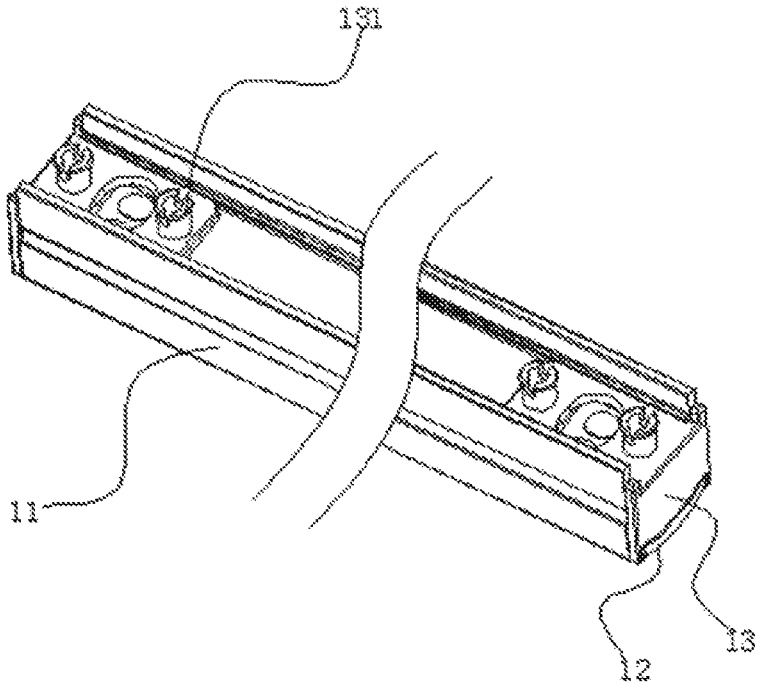
Figure 3:
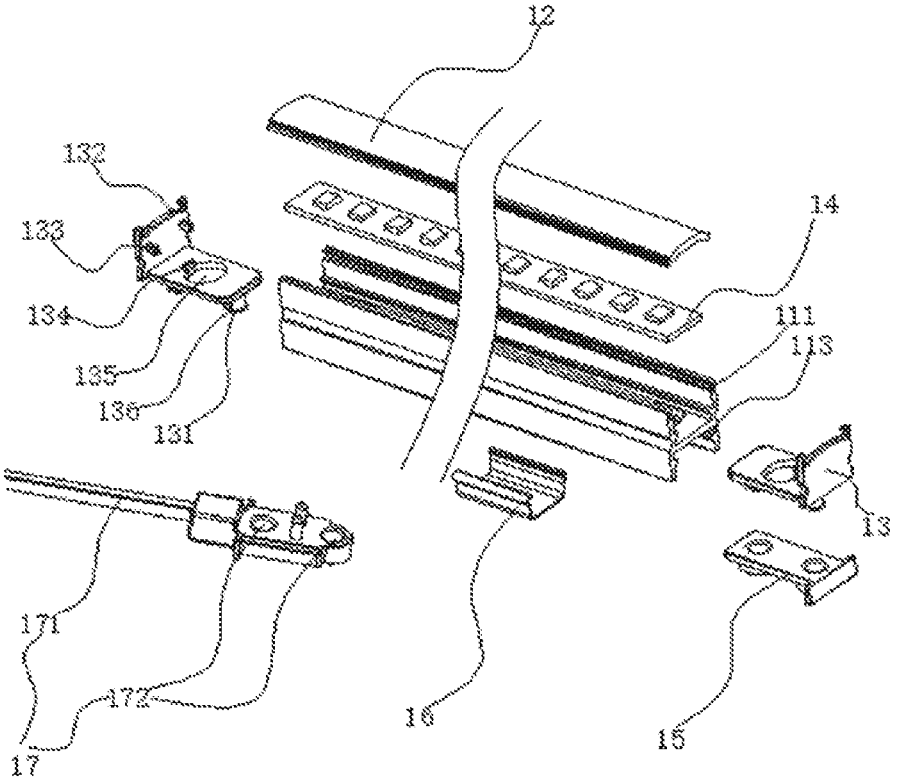
FIG. 3 is a structural schematic diagram of an exploded state of the quick-connect modular LED lamp strip according to the present disclosure.
Figure 4:
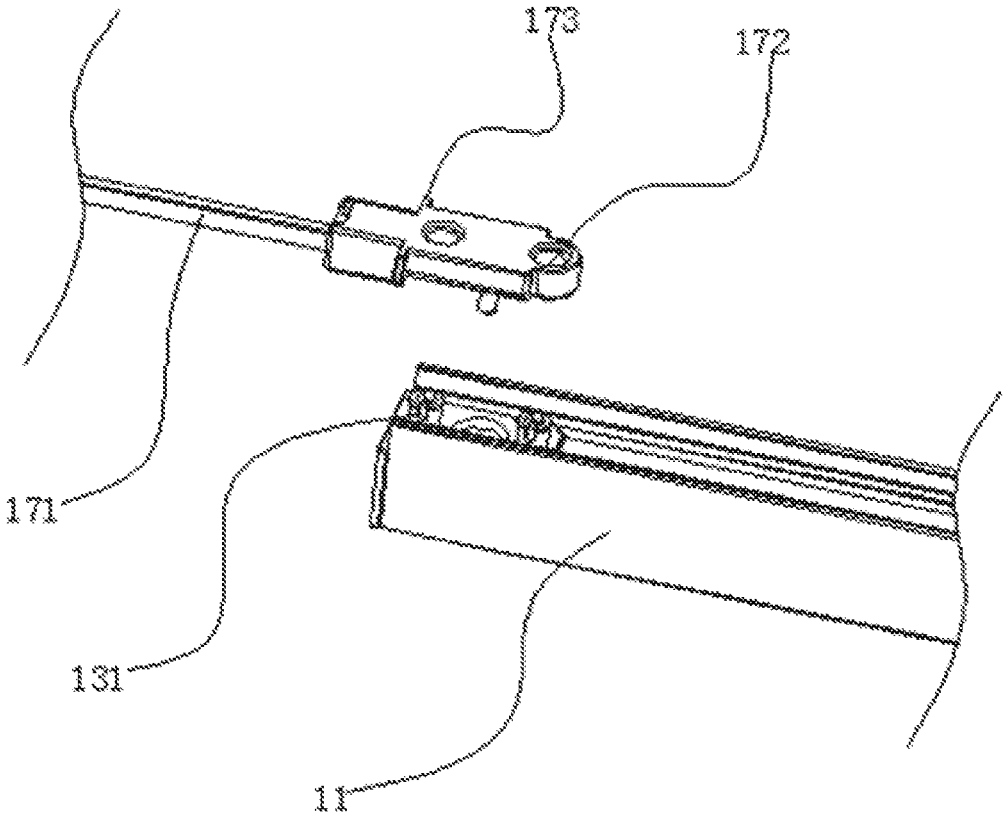
FIG. 4 is a structural schematic diagram of an assembly state of the quick-connect modular LED lamp strip according to the present disclosure.
Figure 5:
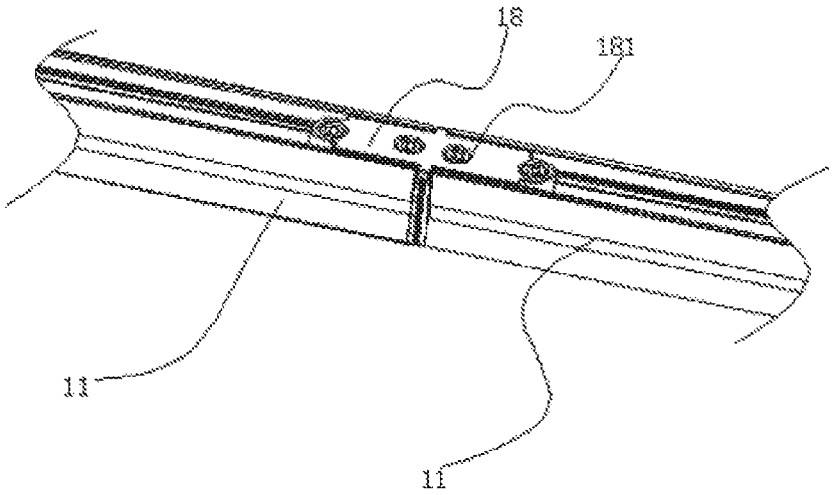
FIG. 5 is a structural schematic diagram of a using state of the quick-connect modular LED lamp strip according to the present disclosure.

As shown in FIGS. 1-5, the present disclosure provides a quick-connect modular LED lamp strip 1, including an H-shaped lamp body 11, a PC lampshade 12 in a movably snap-fit connection with an upper portion of the lamp body 11, a plug wiring assembly 17 connected with the lamp body 11, a printed circuit board (PCB) circuit board 14 disposed inside the lamp body 11, and end caps 13 disposed on each of head position of two ends of the lamp body 11 and configured to block the two ends of the lamp body 11. The end caps 13 are in an L-shaped structure, and each of the end caps 13 includes an end cap insert configured to insert into the lamp body 11 and at least one fixing column 131 integrally formed with the end cap insert and configured to connect with the plug wiring assembly. A lampshade clamping groove 132 is disposed on an upper portion of one side of each of the end caps 13, a shape of the lampshade clamping groove 132 matches with a shape of the PC lampshade 12, and the lampshade clamping groove 132 is configured to clamp and fix the PC lampshade 12. A lamp panel groove 111 is disposed on an upper portion of one side of the lamp body 11 and is configured to clamp the PCB circuit board 14, and an insert groove 113 is disposed on a lower portion of an inner side of the lamp body 11 and is configured to insert the cap end inserts. Each of the end caps 13 further includes an end cap power outlet 135 formed on the end cap insert and a lamp body power outlet formed on each end of the lamp body 11 and matched with a position where the end cap power outlet 135 is located.

The present disclosure provides the quick-connect modular LEI) lamp strip, which is simultaneously disposed with the H-shaped lamp body 11, the PC lampshade 12 in the movably snap-fit connection with the upper portion of the lamp body 11, the plug wiring assembly 17 connected with the lamp body 11, and combined with the printed circuit board (PCB) circuit board 14 disposed inside the lamp body 11 and the end caps 13 disposed on each of the head position of two ends of the lamp body 11 and configured to block the two ends of the lamp body 11. Moreover, the end caps 13 are in the L-shaped structure, and each of the end caps 13 includes the end cap insert configured to insert into the lamp body 11 and at least one fixing column 131 integrally formed with the end cap insert and configured to connect with the plug wiring assembly. The lampshade clamping groove 132 is disposed on the upper portion of one side of each of the end caps 13, the shape of the lampshade clamping groove 132 matches with the shape of the PC lampshade 12, and the lampshade clamping groove 132 is configured to clamp and fix the PC lampshade 12. The lamp panel groove 111 is disposed on the upper portion of one side of the lamp body 11 and is configured to clamp the PCB circuit board 14, and the insert groove 113 is disposed on the lower portion of the inner side of the lamp body 11 and is configured to insert the cap end inserts. Each of the end caps further includes an end cap power outlet formed on the end cap insert and a lamp body power outlet formed on each end of the lamp body and matched with a position where the end cap power outlet is located. A structure of the quick-connect LED lamp strip adopts a modular design concept, abandoning a backward wiring method, the lamp strip does no need to be welded, is free of glue, and has no need of fixing screws, which simplifies a production process. Through a simple structural design, one lamp is quickly connected with another lamp, and a connection between the two lamps achieves a no shadow effect, which has an excellent appearance and high cost performance, and further enhances product texture and user experience.

The fixing column 131 is in an anti-buckling structure. A groove body 136 is disposed on a middle portion of the fixing column 131 and is configured to enable the fixing column 131 to have internal shrinkage performance.

A tail end cap body 15 is disposed on one side of the lamp body 11. Tail end cap fixing holes are formed on the tail end cap body 15, and the tail end cap fixing holes are matched with a position where the fixing column 131 on each of the end cap inserts is located and are configured to block the lamp body power outlet on an end tail of the lamp body 11. Protrusions are disposed on both sides of the tail end cap body 15, the protrusions are matched with the end caps 13 and are configured to quickly position and connect the fixing column 131 of one of the end caps with the tail end cap body 15.

Guidance columns 133 are integrally disposed on one side of the lampshade clamping groove 132 on each of the end caps 13, the guidance columns 133 are configured to limit and guide a process of inserting the end caps 13 into the lamp body 11. Guidance grooves are disposed on the lamp body 11, and a shape of the guidance grooves is matched with a shape of the guidance columns 133.

An oblique latch is 134 integrally disposed close to the end cap power outlet 135 on each of the end caps 13, a latch hole matched with the oblique latch 134 is disposed on the lamp body 11.

An electrical connector 18 configured to connect other lamp strips is connected with one end of the lamp body 11. Connecting holes 181 connected with the fixing column 131 of each of the end caps 13 are formed on the electrical connector 18. The electrical connector 18 is a "-" shape, "T" shape, or "+" shape.

A fixing buckle 16 is sleeved on an outer side of the lamp body 11.

Electric welding disc contacts are disposed on a left end and a right end of a bottom of the PCB circuit board 14, and the electric welding disc contacts are located on a center of the lamp body 11 and the end cap power outlet 135 of each of the end cap inserts.

The plug wiring assembly 17 includes a power wire 171, an FR-4 PCB plate, and a spring copper needle. The spring copper needle is welded and connected to the FR-4 PCB plate. Fixing holes 172, matched with the fixing columns 131 of the end cap inserts and configured to fix the plug wiring assembly 17 and the lamp body 11, are disposed on both sides of the spring copper needle.

Plug wiring protrusions 173, configured to quickly position and connect the fixing column 131 of each of the end caps 13 and the plug wiring assembly 17, are disposed on both sides of the plug wiring assembly 17.

The end caps 13 are configured to be sealing components of the quick-connect modular LED lamp strip, a clamping groove is disposed on an upper portion of the end caps 13, so that head portion of the PC lampshade 12 is flush with an outer side surface of each of the end caps 13, a light diverges from a side of the PC lampshade 11 to achieve effects that regions of the end caps 13 have uniform light emission and no shadow. The guidance columns 133 are respectively disposed on a left side and a right side of an upper portion of an inner side of the each of the end caps 13 and are matched with an upper aluminum groove portion of the lamp body 11 to limit the end caps swing from side to side. The end cap insert is disposed on a lower portion of the inner side of each of the end caps, the oblique latch 134 is disposed on a top layer of the end cap insert, and a position of oblique latch is matched with a position of the latch hole on the lamp body 11. When the end caps 13 are installed, the oblique latch 134 is inserted into the lamp body 11 along the clamping groove in the lower portion of the lamp body 11, and when the oblique latch reaches the position of the latch hole, the end cap insert bounces upwards, and the oblique latch is embedded into a hole card of the latch hole, so as to fix the plug 13. The lamp body power outlet is disposed inside the end cap insert, and a power taking device is inserted into the lamp power outlet. At least one fixing column 131 is disposed on a bottom layer each of the end cap inserts, the fixing column 131 is in an anti-buckling structure. The groove body is disposed on a middle portion of the fixing column and is configured to enable the fixing column to have internal shrinkage performance. When the fixing column is inserted into the corresponding connecting hole on the electrical connector, a tail portion of the fixing column is reversely buckled and popped up to buckle a bottom of the electrical connector, so that the electrical connector is fixed. Fool-proof notches are disposed on a bottom of both of the end caps, which are configured to quickly position and connect the plug wiring assembly, the electrical connector, and the tail end cap components.

The lamp body 11 is in an H-shape, a first clamping groove for the PC lampshade 12 is disposed on the upper portion of the lamp body 11, a second clamping groove for an LED lamp panel is disposed on an upper portion of a middle partition plate of the lamp body 11 and is configured to fix the LED lamp panel. A third clamping groove is further disposed in the lower portion of the lamp body 11 and is configured to be inserted by the end cap insert and install the fixing buckle. The lamp body power outlet is disposed on each end of the middle partition plate, the lamp body power outlet is coincident with the end cap power outlet. The latch hole is disposed besides the lamp body power outlet to fix the end cap components.

The PCB printed circuit board 14 is an FR-4 double-sided PCB. The PCB top layer is attached with LED lamp beads and a driving circuit element. The electric welding disc contacts are disposed on a left end and a right end of a bottom of the PCB circuit board. The electric welding disc contacts are located on a center of the lamp body and the end cap power outlet of each of the end cap inserts.

Compared with the prior art, the quick-connect modular LED lamp strip is simultaneously disposed with the H-shaped lamp body 11, the PC lampshade 12 in the movably snap-fit connection with the upper portion of the lamp body 11, the plug wiring assembly 17 connected with the lamp body 11, and combined with the printed circuit board (PCB) circuit board 14 disposed inside the lamp body 11 and the end caps 13 disposed on each of head position of two ends of the lamp body 11 and configured to block the two ends of the lamp body 11. Moreover, the end caps 13 are in the L-shaped structure, and each of the end caps 13 includes the end cap insert configured to insert into the lamp body 11 and at least one fixing column 131 integrally formed with the end cap insert and configured to connect with the plug wiring assembly. The lampshade clamping groove 132 is disposed on the upper portion of one side of each of the end caps 13, the shape of the lampshade clamping groove 132 matches with the shape of the PC lampshade 12, and the lampshade clamping groove 132 is configured to clamp and fix the PC lampshade 12. The lamp panel groove 111 is disposed on the upper portion of one side of the lamp body 11 and is configured to clamp the PCB circuit board 14, and the insert groove 113 is disposed on the lower portion of the inner side of the lamp body 11 and is configured to insert the cap end inserts. Each of the end caps further includes an end cap power outlet formed on the end cap insert and a lamp body power outlet formed on each end of the lamp body and matched with a position where the end cap power outlet is located. A structure of the quick-connect LED lamp strip adopts a modular design concept, abandoning a backward wiring method, the lamp strip does no need to be welded, is free of glue, and has no need of fixing screws, which simplifies a production process. Through a simple structural design, one lamp is quickly connected with another lamp, and a connection between the two lamps achieves an effect that there is no shadow, which is with an excellent appearance and high cost performance, and further enhances product texture and user experience.

The embodiments of the present disclosure described above do not constitute a limitation on scopes of the present disclosure. Any modifications, equivalents, and improvements made within the spirit and principles of the present disclosure are intended to be included within the scopes of the appended claims.

What is claimed is:

1. A quick-connect modular LED lamp strip, comprising an H-shaped lamp body, a PC lampshade in a movably snap-fit connection with an upper portion of the lamp body, a plug wiring assembly connected with the lamp body, a printed circuit board (PCB) circuit board disposed inside the lamp body, and end caps disposed on each of head position of two ends of the lamp body and configured to block the two ends of the lamp body; the end caps are in an L-shaped structure, and each of the end caps comprises an end cap insert configured to insert into the lamp body and at least one fixing column integrally formed with the end cap insert and configured to connect with the plug wiring assembly; a lampshade clamping groove disposed on an upper portion of one side of each of the end caps, a shape of the lampshade clamping groove matches with a shape of the PC lampshade, and the lampshade clamping groove is configured to clamp and fix the PC lampshade; a lamp panel groove is disposed on an upper portion of one side of the lamp body and is configured to clamp the PCB circuit board, and an insert groove is disposed on a lower portion of an inner side of the lamp body and is configured to insert the cap end inserts; each of the end caps further comprises an end cap power outlet formed on each of the end cap inserts and a lamp body power outlet formed on each end of the lamp body and matched with a position where the end cap power outlet is located; and the fixing column is in an anti-buckling structure; a groove body is disposed on a middle portion of the fixing column and is configured to enable the fixing column to have internal shrinkage performance.

2. The quick-connect modular LED lamp strip according to claim 1, wherein a tail end cap body is disposed on one side of the lamp body; tail end cap fixing holes are formed on the tail end cap body, and the tail end cap fixing holes are matched with a position where the fixing column on each of the end cap inserts is located and are configured to block the lamp body power outlet on an end tail of the lamp body; protrusions are disposed on both sides of the tail end cap body, the protrusions are matched with the end caps and are configured to quickly position and connect the fixing column of one of the end caps with the tail end cap body.

3. The quick-connect modular LED lamp strip according to claim 1, wherein guidance columns are integrally disposed on one side of the lampshade clamping groove on each of the end caps, the guidance columns are configured to limit and guide a process of inserting the end caps into the lamp body; guidance grooves are disposed on the lamp body, and a shape of the guidance grooves is matched with a shape of the guidance columns.

4. The quick-connect modular LED lamp strip according to claim 1, wherein an oblique latch is integrally disposed close to the end cap power outlet on each of the end caps; a latch hole matched with the oblique latch is disposed on the lamp body.

5. The quick-connect modular LED lamp strip according to claim 1, an electrical connector configured to connect other lamp strips is connected with one end of the lamp body; connecting holes connected with the fixing column of each of the end caps are formed on the electrical connector; and the electrical connector is a "-" shape, "T" shape, or "+" shape.

6. The quick-connect modular LED lamp strip according to claim 1, wherein a fixing buckle is sleeved on an outer side of the lamp body.

7. The quick-connect modular LED lamp strip according to claim 1, wherein electric welding disc contacts are disposed on a left end and a right end of a bottom of the PCB circuit board; and the electric welding disc contacts are located on a center of the lamp body and the end cap power outlet of each of the end cap inserts.

8. The quick-connect modular LED lamp strip according to claim 1, wherein the plug wiring assembly comprises a power wire, an FR-4 PCB plate, and a spring copper needle; the spring copper needle is welded and connected to the FR-4 PCB plate; fixing holes, matched with the fixing columns of the end cap inserts and configured to fix the plug wiring assembly and the lamp body, are disposed on both sides of the spring copper needle.

9. The quick-connect modular LED lamp strip according to claim 7, wherein plug wiring protrusions, configured to quickly position and connect the fixing column of each of the end caps and the plug wiring assembly, are disposed on both sides of the plug wiring assembly.

* * * * *